United States Patent [19]

Zaoralek

[11] Patent Number: 4,734,966

[45] Date of Patent: Apr. 5, 1988

[54] HEATABLE GLAZING OR CALENDERING ROLL

[75] Inventor: Heinz-Michael Zaoralek, Königsbronn, Fed. Rep. of Germany

[73] Assignee: Schwäbische Huttenwerke GmbH, Fed. Rep. of Germany

[21] Appl. No.: 916,758

[22] Filed: Oct. 8, 1986

[30] Foreign Application Priority Data

Oct. 10, 1985 [DE] Fed. Rep. of Germany ..... 3536236

[51] Int. Cl.[4] ..... B21B 1/00

[52] U.S. Cl. ..... 29/129; 29/110; 29/130

[58] Field of Search ..... 29/110, 129, 130, 116 R, 29/116 AD; 165/89, 90, 91; 100/155 R, 161, 168, 907, 908

[56] References Cited

U.S. PATENT DOCUMENTS

| | | | |
|---|---|---|---|
| 1,563,216 | 11/1925 | Moog . | |
| 3,950,897 | 4/1976 | Birkenstack et al. . | |
| 4,187,594 | 2/1980 | Appenzeller | 29/116 AD |
| 4,459,726 | 7/1984 | O'Brien et al. | 29/116 AD |

FOREIGN PATENT DOCUMENTS

| | | | |
|---|---|---|---|
| 1134272 | 12/1957 | Fed. Rep. of Germany . | |
| 1561732 | 7/1969 | Fed. Rep. of Germany . | |
| 1940175 | 2/1971 | Fed. Rep. of Germany . | |
| 3014891 | 4/1980 | Fed. Rep. of Germany . | |
| 46281 | 11/1973 | Finland . | |
| 283102 | 7/1970 | Sweden . | |
| 283894 | 8/1970 | Sweden . | |
| 386303 | 4/1965 | Switzerland | 29/116 R |
| 304325 | 12/1969 | U.S.S.R. | 29/116 AD |
| 453467 | 6/1973 | U.S.S.R. | 29/116 AD |

OTHER PUBLICATIONS

Vortrag, "Verbesserung des Papierprofils und der Glatte durch beheizte Glattwerk- und Kalanderwalzen", von Peter Rothenbacher, Erich Vomhoff und Michael Zaoralek auf der Haupttagung des OZEPA an 18.10.1984 in Klangenfurt.

*Primary Examiner*—Howard N. Goldberg
*Assistant Examiner*—Irene Cuda
*Attorney, Agent, or Firm*—Armstrong, Nikaido, Marmelstein & Kubovcik

[57] ABSTRACT

A heatable glazing or calendering roll which includes a cylindrical hollow body, bearing journals for each end of the cylindrical hollow body, a displacement body arranged in the cylindrical hollow body, and supply and discharge lines in each bearing journal for a fluid heat carrier which flows through the annular gap between the displacement body and the cylindrical hollow body. A cylindrical flow chamber is provided at each end between the displacement body and the bearing journals and guiding means are arranged in each flow chamber, to accelerate the heat carrier at the inlet end in the peripheral direction and slow down the heat carrier from its peripheral speed at the outlet end, so that there can no longer occur any significant whirls. In this manner the otherwise occurring loss of pressure of the heat carrier can be reduced to a third or a quarter of the otherwise usual value.

9 Claims, 2 Drawing Sheets

HEATABLE GLAZING OR CALENDERING ROLL

BACKGROUND OF THE INVENTION

1. Field of the Invention

The invention relates to a heatable glazing or calendering roll in which a fluid heat carrier flows through an annular gap between a displacement body and a cylindrical hollow body.

2. Description of the Prior Art

Such a roll known for example from DE-OS No. 3 014 891, and also from the prior U.S. patent application Ser. No. 863,261 is used, in particular, for making and processing paper. In this connection, the surface temperature of the roll has to be influenced frequently, that is to say its surface has to be heated or cooled. In the majority of cases this is done by means of a fluid heat carrier flowing through the roll, that is steam, water or oil; this heat carrier is heated or cooled outside the roll and is then guided through the roll.

In order to obtain good heat transfer the fluid heat carrier has to approached to the surface of the roll as closely as possible. For this purpose the central bore of the cylindrical hollow body is broadened so that a cylindrical displacement body can be inserted into the central bore and the fluid heat carrier flows through a narrow annular gap between the displacement body and central bore.

Examinations of such heatable glazing or calendering rolls have shown, however, that despite the use of fluid heat carriers, for instance, of water or oil, the surface of the roll does not have a uniform temperature, due to which, for one thing, the web material to be processed is influenced in a negative way and, for the other, the shape of the roll varies adversely. As early as in the 60's the influence of shape changes of the glazing roll, due to axial and radial temperature differences, on the roll profile and thus also on the paper profile was examined (cf. the lecture "Improving the Paper Profile and the Gloss by Heated Glazing and Calendering Rolls" given by Peter Rothenbacher, Erich Vomhoff and Michael Zaoralek at the main congress of the ÖZEPA in Klagenfurth on Oct. 18, 1984). If in accordance with a usual rule of thumb for the heat expansion of iron and/or steel at a temperature difference of 1° C. and a reference length of 1000 mm a diameter change of about 10 $\mu$m is assumed, a temperature change of 4° C. in a roll having a rated diameter of 710 mm will manifest itself in an increase in the diameter of 15 $\mu$m. Such minor temperature fluctuations occurring at points with different flow rates due to the involved different heat transfer coefficients and the roll's shape changes resulting therefrom cannot be kept under control even by carefully setting the temperature of the fluid heat carrier.

SUMMARY OF THE INVENTION

Therefore, the invention has as its object to provide a heatable glazing or calendering roll of the given type in which the aforementioned disadvantages do not occur. In particular, a roll is to be proposed which has a very uniform temperature over its entire surface.

According to the invention this is achieved in a heatable glazing or calendering roll with a cylindrical hollow body, with a bearing journal for each end of the cylindrical hollow body, with a displacement body disposed in the cylindrical hollow body, with supply and discharge lines for a fluid heat carrier which flows through the annular gap between the displacement body and the cylindrical hollow body, and with a flow chamber between the end face of the displacement body and the opposite end faces of the bearing journals, by the improvement in which in the flow chamber a flow guiding means is arranged which accelerates the inflowing heat carrier in peripheral direction and slows down the out-flowing heat carrier from its peripheral speed.

Expedient forms of embodiment are defined by the features of the subordinate claims.

The advantages achieved with the invention are based on the following function: A glazing or calendering roll having a cylindrical displacement body has at each roll end a cylindrical flow chamber between each end of the displacement body and the associated journal; the heat carrier freely flows through this flow chamber.

When operating such rolls it has been found that there occurs a considerable loss of pressure when the heat carrier is passing through the rotating roll.

The cause of this was found to be an unfavorable flow design, and to compensate for this loss of pressure, pumps having a higher delivery pressure head have been considered for use.

Instead of these potential, however, relatively costly solutions, which, moreover, do not obviate the aforementioned heat transfer problems, the real causes of such a pressure loss have been found, so that they can be obviated by means of a simple reconstruction of the flow chamber.

In this connection a distinction has to be made between the inlet and outlet sides receiving and discharging a heat carrier flowing through such a roll.

On the inlet side of the roll the heat carrier flowing through the central bore of the journal has a velocity component in axial direction only, and no velocity component in the peripheral direction. In the cylindrical flow chamber between displacement body and journal the heat carrier is radially deflected in an outward direction; upon rotation of the roll so-called "Coriolis forces" act upon the heat carrier in this area and perpendicularly deflect it towards the plane defined by the rotational axis and the direction of motion of the fluid heat carrier, which leads to a strong turbulence of the heat carrier and to corresponding pressure losses.

Upon entering the annular gap the heat transfer carrier first of all does not flow in axial direction relative to the rotating roll but in a diagonal direction.

It is in particular the supports arranged in the initial area as well as the friction at the gap walls which deflect the heat carrier to such an extent that it only flows in the axial direction through the annular gap. This, too, leads to whirl losses.

On the outlet side this process takes place vice versa. At a peripheral velocity corresponding to the speed of the roll the heat carrier is pressed radially inwardly towards the central outlet opening in the journal in the cylindrical hollow chamber between the journal and displacement body. According to the law of conservation of angular momentum the moment of momentum remains constant when the radius is changed. However, when reducing the radius the peripheral velocity is increased so that the heat carrier, on its way from the radial, outer, annular gap to the central outlet opening in the gap, is highly accelerated to become a whirl. The high centrifugal forces occurring in this connection oppose the radial flow and-as shown by means of tests-are responsible for the vast part of the pressure loss.

According to the invention these two causes of the pressure losses are eliminated by means of building guiding means into the cylindrical hollow chamber between the end faces of the displacement body and each associated journal, which prevent whirls from being formed in this hollow chamber on the inlet and outlet sides. At the inlet the heat carrier is accelerated in the peripheral direction by means of this guiding means, whereas at the outlet it is slowed down from the velocity it has when axially flowing through the annular gap. No significant whirls can occur in this case so that the loss of pressure, as compared with a roll without a guiding means, can be reduced to a third or quarter, as has been proven with the help of tests.

Rolls with such guiding means can be operated with pumps of a lower delivery head, which means a relevant reduction of costs. Moreover, the flow conditions within the roll are evened out, which is of great significance as regards the desired shape accuracy of the roll. For in the case of irregular flow an irregular heat transfer from the heat carrier to the roll shell will take place, due to which the above-mentioned temperature differences in the interior and on the surface of the roll may result.

The guiding means may be constructed in various ways. Thus, common displacement bodies have at their ends a cylindrical hollow body with recesses, which generally consists of sheet metal and projects over the end wall of the displacement body, through which recesses the heat carrier may flow. Next to these recesses there may be welded onto blades projecting radially inwardly into the cylindrical hollow body, the inner ends of which are located on about the level of the outer diameter of the central flow opening in the associated journal.

As an alternative also a separated cylindrical body can be arranged in the cylindrical hollow chamber between the end side of the displacement body and the associated journal, which separated cylindrical body is mounted to the displacement body and/or the journal and/or the cylindrical hollow body of the roll in a suitable manner. On the inner face of this additional, annular body there may also be fixed blades; for instance, they may be welded onto said face.

Finally, it is also possible to mount the blades to the inner face of the cylindrical hollow body of the roll shell or to the end face or the central flow opening of the associated journal, respectively.

For the purpose of expediency at least two blades provided at each end of the roll are considered sufficient, for rolls having a maximum diameter of 700 mm. These two blades are expediently arranged at an angle of circumference of 180°.

If the rolls have a diameter ecxeeding 700 mm, four blades should be provided on each side, which together from an angle of circumference of 90° each.

BRIEF DESCRIPTION OF THE DRAWINGS

The invention is described in more detail hereinafter with the help of examples of embodiment with reference to the accompanying diagrammatic drawings. In these drawings

DESCRIPTION OF THE PREFERRED EMBODIMENT

Figure 1:
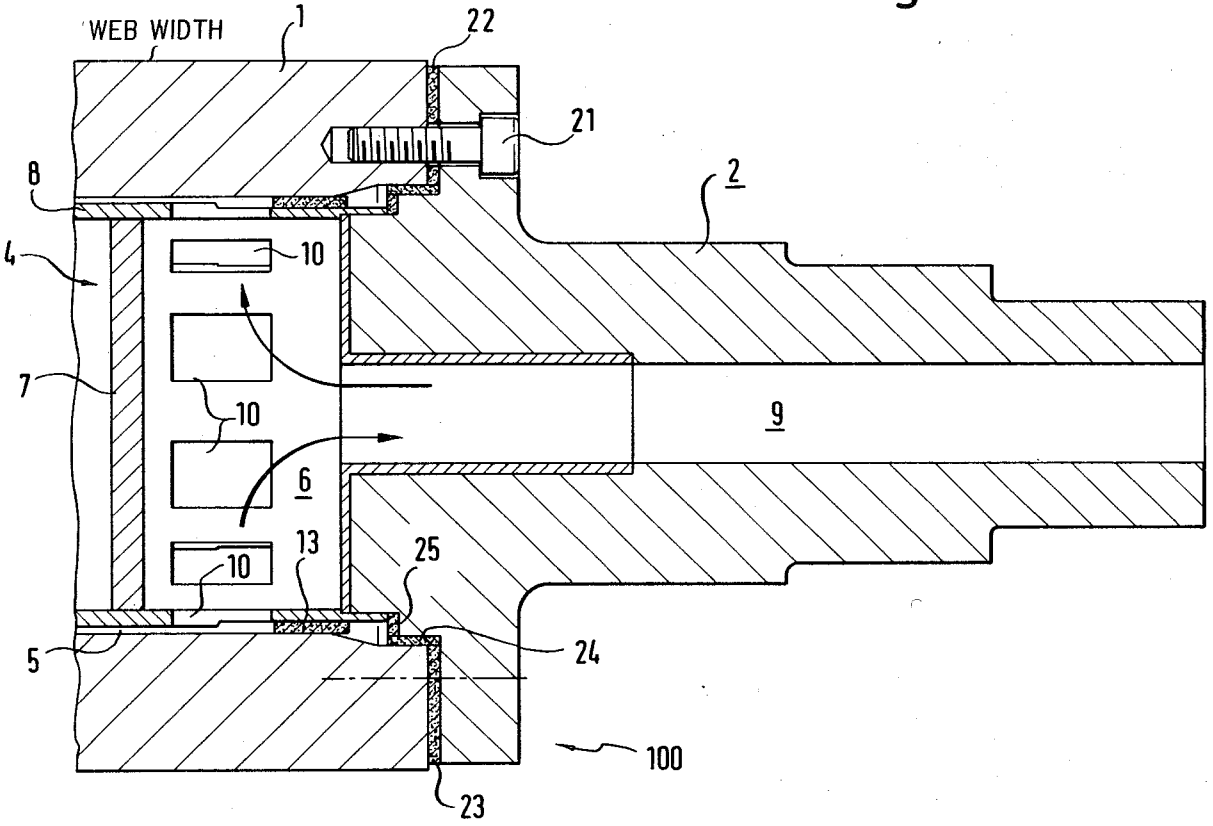
FIG. 1 is a sectional view through the end region of a heatable glazing or calendering roll.

The heatable glazing and calendering roll illustrated in FIG. 1 and designated generally by the reference numeral 100 comprises a cylindrical hollow body 1 which is cast in iron or steel and which at its two ends (in FIG. 1 only the right end is shown) is mounted by bearing journals 2. The bearing journals 2 are screwed to the corresponding end wall of the cylindrical hollow body 1 in the usual manner and centered in a turned-out recess at the end of the cylindrical hollow body 1 with an appropriate projection. The rotationresistant, rigid connection between the bearing journal 2 and the cylindrical hollow body 1 is effected by a plurality of screws which are distributed over the periphery of the roll 100 at equal angular intervals, of which one screw 21 is indicated in FIG. 1.

The hollow space between the bearing journals 2 and the cylindrical hollow body 1 is, except for a narrow annular gap 5, filled out by a displacement body 4 which at its two ends between the bearing journal 2 and its end wall 7 leaves free a roughly drum-shaped flow chamber 6.

The displacement body 4 consists of a steel tube 8 which is thin compared with the cylindrical body 1 and which with its two ends, as shown in the drawings, is centered on a corresponding projection of the bearing journal 2. In the axial direction the sheet metal cylinder 8 of the displacement body 4 with the clearance necessary in practice engages the end face of the bearing journal 2. The steel tube is welded to two circular sheet metal disks 7 forming the end walls of the displacement body 4. The sheet metal disk 7 is spaced from the left end face of the bearing journal 2 as according to the illustration in FIG. 1 at such a distance that it leaves free the mentioned drum-shaped flow chamber 6 between itself and said end face.

In FIG. 1 a top arrow indicates the flow entry of the fluid heat carrier, i.e. water or oil, while the bottom arrow indicates the flow path at the other end of the roll, where the flow leaves the roll 100 again.

For the flow to be able to pass from a channel 9 centrally running through the bearing journal 2 via the flow chamber 6 and into the annular gap between the displacement body 4 and the cylindrical hollow body 1, windows 10 are provided in the part of the cylindrical hollow body 8, which projects beyond the end wall 7, through which windows the heat carrier is flowing. At the other end this roll 100 has an analogous construction.

The width of the web to be treated with the roll, for instance, a paper web, is indicated at the top of the Figure and is designated "web width".

Moreover, in FIG. 1 various, heat-insulating layers 13, 22, 24, 25 are indicated, as described in the prior U.S. patent application Ser. No. 863,261.

In order to prevent the above-mentioned pressure losses in the deflection of the flow from the central channel 9 to the annular gap 5 or vice versa, guiding means are provided in the cylindrical flow chamber 6, which accelerate the heat medium in the peripheral direction at the inlet end and slow it down at the outlet from its peripheral velocity, so that no significant whirls can occur.

Figure 2:
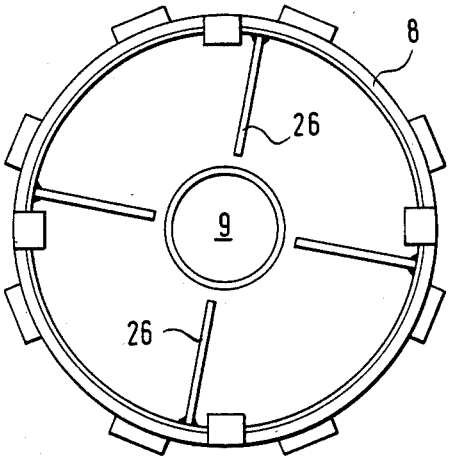
FIG. 2 is a front view of the cylindrical hollow body on one end of the displacement body.

For this purpose in the embodiment according to FIG. 1 adjacent to four windows 10 located side by side at an angle of circumference of 90° each there are welded blades 26 projecting radially inwardly in the flow chamber 6, as can be seen from FIG. 2. The inner ends of the blades 26 are located on about the circumference of the central flow channel 9 in the journal 2.

Such a guiding means with four blades 26 is only required if the roll 100 has a diameter of more than 700 mm. At a diameter of less than 700 mm two blades 26 on each side of the roll 100 are sufficient.

As an alternative thereto it is also possible that the displacement body 4 ends at the end face 7, that is the flow chamber 6 is, on the outside, enclosed by a separate annular body corresponding to the part of the cylindrical hollow body 8, which projects over the end wall 7.

This separated hollow body may be provided with windows 10, adjacent to which the blades 26 are welded into the hollow body in the manner as shown in FIG. 2.

Finally, it is still possible to mount such blades 26 to the inner peripheral face of the bore of the cylindrical hollow body 1, to the end face of the journal 2 or to the inner face of the channel 9 of the journal 2.

I claim:

1. In a heatable glazing or calendering roll of the type which includes a cylindrical hollow body, a bearing journal at each end of the cylindrical hollow body, a displacement body disposed internally of the cylindrical hollow body and defining an annular gap therebetween, supply and discharge means for a fluid heat carrier which flows through the annular gap between the displacement body and the cylindrical hollow body, and a flow chamber between each end face of the displacement body and the opposite end face of one of said bearing journals, the improvement which comprises:

flow guiding means arranged in each respective flow chamber to accelerate the in-flowing heat carrier flow from said supply means radially outward and to retard radial inward flow of said heat carrier from said annular gap to said discharge means.

2. A heatable glazing or calendering roll according to claim 1, wherein said flow guiding means is formed by at least two blades radially projecting into each said flow chamber.

3. A heatable glazing or calendering roll according to claim 2, wherein said supply and discharge means comprise internal channels concentric with said bearing journals and the inner ends of said blades are located adjacent periphery of said flow channels internal of said bearing journals.

4. A heatable glazing or calendering roll according to claim 2, in which the diameter of said roll is no greater than 700 mm and two blades are arranged relative to each other at an angle of circumference of 180° in each said flow chamber.

5. A heatable glazing or calendering roll according to claim 2, in which the diameter of said roll is greater than 700 mm and four blades are arranged relative to each other at an angle of circumference of 90°.

6. A heatable glazing or calendering roll according to claim 2, wherein said displacement body is comprised of a tubular member, said end faces are comprised of end wall means provided internally of said tubular member and said tubular member extends beyond each of said wall means toward said bearing journals, said tubular member extending beyond said wall means is provided with windows for the fluid heat carrier to flow through and said blades are mounted adjacent to said windows.

7. A heatable glazing or calendering roll according to claim 2, in which said blades are welded to the cylindrical hollow body.

8. A heatable glazing or calendering roll according to claim 2, in which a separate annular body with two blades is arranged in the flow chamber.

9. A heatable glazing or calendering roll according to claim 2 in which said blades are welded to said bearing journals.

* * * * *